US007968508B2

(12) United States Patent
Michels et al.

(10) Patent No.: US 7,968,508 B2
(45) Date of Patent: Jun. 28, 2011

(54) BENZOPHENONE OR BENZOIC ACID ANILIDE DERIVATIVES CONTAINING CARBOXYL GROUPS AS ENZYME STABILIZERS

(75) Inventors: Andreas Michels, Duesseldorf (DE); Robin Ghosh, Duesseldorf (DE); Cornelius Bessler, Duesseldorf (DE); Daniela Lowis, Haan (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 12/554,264

(22) Filed: Sep. 4, 2009

(65) Prior Publication Data

US 2010/0062964 A1 Mar. 11, 2010

Related U.S. Application Data

(63) Continuation of application No. PCT/EP2007/063260, filed on Dec. 4, 2007.

(30) Foreign Application Priority Data

Mar. 6, 2007 (DE) ..... 10 2007 011 236

(51) Int. Cl.
*C11D 3/00* (2006.01)
*D06M 16/00* (2006.01)

(52) U.S. Cl. ..... 510/392; 510/398; 435/264

(58) Field of Classification Search ..... 510/320, 510/392, 398; 549/286; 435/264
See application file for complete search history.

(56) References Cited

FOREIGN PATENT DOCUMENTS

| | | | |
|---|---|---|---|
| EP | 0 378 261 | A2 | 7/1990 |
| WO | WO 91/02792 | A1 | 3/1991 |
| WO | WO 95/23221 | A1 | 8/1995 |
| WO | WO 96/41589 | A1 | 6/1996 |
| WO | WO 96/21716 | A1 | 7/1996 |
| WO | WO 98/22567 | A1 | 5/1998 |
| WO | WO 02/08398 | A2 | 1/2002 |
| WO | WO 2007/113241 | A1 | 10/2007 |

OTHER PUBLICATIONS

L. Michaels et al., "Die Kinetik der Invertinwirkung," *Biochemische Zeitschrift*, vol. 49, Feb. 1913, pp. 333-369.
Yung-Chi Cheng et al., "Relationship between the Inhibition constant ($K_I$) and the Concentration of Inhibitor which causes 50 per cent Inhibition ($I_{50}$) of an Enzymatic Reaction*," *Biochemical Pharmacology*, vol. 22, Pergamon Press 1973, pp. 3099-3108.
David J. Lipman et al., "Rapid and Sensitive Protein Similarity Searches," *Science*, vol. 227, Mar. 1985, pp. 1435-1441.
Hans Georg Van Raay et al., "Zur Bestimmung der proteolytischen Aktivitaet in Enzymkonzentraten und enzymhaltigen Wasch-, Spuel- und Reinigungsmitteln," *Tenside*, vol. 7, No. 3, Mai/Jun. 1970, pp. 125-132.
Daniel F. Wyss et al., "Non-Peptidic Small-Molecule Inhibitors of the Single-Chain Hepatitis C Virus NS3 Protease/NS4A Cofactor Complex Discovered by Structure-Based NMR Screening," *J. Med. Chem.*, vol. 47, 2004, pp. 2486-2498.
International Search Report of PCT/EP2007/063260, dated Feb. 29, 2008.

*Primary Examiner* — Taylor Victor Oh
(74) *Attorney, Agent, or Firm* — RatnerPrestia

(57) ABSTRACT

Washing and cleaning agents containing benzophenone or benzole anilide derivatives containing carboxyl groups, which function as protease inhibitors and are suitable as enzyme stabilizers. Additional subjects are the use of such compounds as reversible inhibitors of a protease and consequently for a washing or cleaning agent formulation, and additional methods and uses relating thereto.

14 Claims, No Drawings

BENZOPHENONE OR BENZOIC ACID ANILIDE DERIVATIVES CONTAINING CARBOXYL GROUPS AS ENZYME STABILIZERS

CROSS-REFERENCE TO RELATED APPLICATIONS

This application is a continuation under 35 U.S.C. §§120 and 365(c) of International Application PCT/EP2007/063260, filed on Dec. 4, 2007. This application also claims priority under 35 U.S.C. §119 of DE 10 2007 011 236.1, filed on Mar. 6, 2007. The disclosures of PCT/EP2007/063260 and DE 10 2007 011236.1 are incorporated herein by reference in their entirety.

BACKGROUND OF THE INVENTION

The present invention relates to washing and cleaning agents containing benzophenone or benzoic acid anilide derivatives which contain carboxyl groups and which act as protease inhibitors and are thus suitable enzyme stabilizers.

Use of enzymes in washing and cleaning agents is well established in the prior art. They serve to expand the performance spectrum of the respective agents according to their special activities. These include in particular hydrolytic enzymes such as proteases, amylases, lipases and cellulases. The first three of the aforementioned enzymes will hydrolyze proteins, starch and fats and thus contribute directly toward removal of dirt. Cellulases are used in particular because of their tissue effect. Another group of detergent and cleaning agent enzymes are oxidative enzymes, in particular oxidases, which are preferably used to bleach soiling or to create bleaching agents in situ, optionally in conjunction with other components. In addition to these enzymes, which are subjected to ongoing optimization, additional enzymes for use in washing and cleaning agents are constantly being made available in order to be able to optimally approach specific types of soiling, in particular, e.g., pectinases, β-glucanases, mannanases or other hemicellulases for hydrolysis of special plant-based polymers in particular.

Proteases are the enzymes that have been established for the longest time and are contained in practically all modern efficient washing and cleaning agents, including in particular serine proteases, which also include the subtilases. They induce degradation of protein-based soiling on items to be cleaned. However, they also undergo self-hydrolysis (autoproteolysis) as well as hydrolyzing all other proteins contained in the respective agents, i.e., in particular other enzymes. This takes place in particular during the cleaning process, i.e., in the aqueous wash bath, when comparatively favorable reaction conditions prevail. However, this also takes place during storage of the respective agents, which is why a certain loss of enzyme activity, e.g., protease activity, is also associated with longer storage times. As a rule, the enzyme activity in the detergent or cleaning agent is inversely proportional to the storage time with enzyme activity declining further with longer storage times. This is especially problematical in gelatinous or liquid formulations, in particular those containing water, because both the reaction medium and the hydrolysis reagent are available with the water contained in such formulations.

One goal in the development of washing and cleaning agents is thus to stabilize the enzymes contained in them in particular during storage. This is understood to refer to protection against the various unfavorable influences, e.g., against denaturing or decomposition due to physical influences or oxidation. One emphasis of these development consists of protection of the proteins and/or enzymes contained therein against proteolytic cleavage. This may be accomplished by creating physical barriers, e.g., by encapsulation of the enzymes in special enzyme granules or by finishing the agents in two-chamber systems or multi-chamber systems. Another method that is often used consists of the fact that chemical compounds which inhibit the proteases and thus act on the whole as stabilizers for the proteases and the other proteins and enzymes contained therein are added to the agents. These must be reversible protease inhibitors because the protease activity should be suppressed only temporarily, in particular during storage, but not during the cleaning process.

Reversible protease inhibitors known in the prior art include polyols, in particular glycerol and 1,2-propylene glycol, benzamidine hydrochloride, borax, boric acids, boronic acids or salts or esters thereof. Of these, derivatives of aromatic groups, e.g., ortho-, meta- or para-substituted phenyl boronic acids, in particular 4-formylphenyl boronic acid (4-FPBA) and/or the salts or esters of said compounds, should be mentioned in particular. Especially good protection is obtained when boric acid derivatives are used together with polyols because then they can form a complex that stabilizes the enzyme. Peptide aldehydes, i.e., oligopeptides with a reduced C terminus, in particular those of two to five monomers, have been described for this purpose. Reversible peptide protease inhibitors include ovomucoid and leupeptin, among others. Specific reversible peptide inhibitors as well as fusion proteins of proteases and specific peptides inhibitors are used for this purpose.

However, polyols such as glycerol and 1,2-propylene glycol have proven to be non-advantageous because of the high use concentrations required and because the other active ingredients of the respective agents can thus be present only in small proportions accordingly.

Of the serine protease inhibitors, which are effective in comparatively low concentrations, boric acid derivatives assume a predominant position. For example, International Patent Application WO 96/21716 A1 discloses that boric acid derivatives which act as protease inhibitors are also suitable for stabilizing enzymes in washing and cleaning agents. A selection of especially efficient stabilizers is disclosed in the International Patent Application WO 96/41859 A1.

Regardless of their stabilizing effect, however, the boric acid derivatives have an important disadvantage. Many boric acid derivatives such as borate form unwanted byproducts with some other washing and/or cleaning agent ingredients, so that the latter are no longer available for the desired cleaning purpose in the respective agents or may even remain behind as an impurity on the item washed.

DESCRIPTION OF THE INVENTION

The object which thus arises is to identify boron-free chemical compounds which act as protease inhibitors and are thus suitable as enzyme stabilizers in washing and cleaning agents.

Use in washing and cleaning agents that are liquid, gelatinous or pasty on the whole was of particular interest here, including in particular those containing water.

This object is achieved by the following agents:

Washing or cleaning agents containing a protease and a compound of the general structural formula

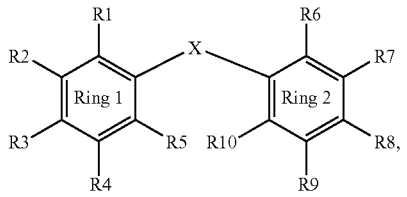

in which (a) X stands for a carbonyl group (C═O) or an acid amide group (NHCO), (b) R1, R2, R3, R4 and R5 (in ring 1) stand for hydrogen (H), a carboxyl group (COOH), a methyl group ($CH_3$), an ethyl group ($C_2H_5$), a hydroxyl group (OH), a hydroxymethyl group ($CH_2OH$), an amino group ($NH_2$) and/or a halogen, such that at least one carboxyl group (COOH) is present in this ring, (c) R6, R7, R8, R9 and R10 (in ring 2) stand for hydrogen (H), a carboxyl group (COOH), a methyl group ($CH_3$), an ethyl group ($C_2H_5$), a hydroxyl group (OH), a hydroxymethyl group ($CH_2OH$), an amino group ($NH_2$) and/or a halogen, such that at least one carboxyl group (COOH) is present in this ring and (d) optionally two of the radicals R1 to R10 are (A) and (B), which are in ortho position to one another, (A) being an obligatory carboxyl group (COOH) mentioned in (b) and/or (c) or optionally an additional carboxyl group, and (B) being a hydroxymethyl group, these being present as such groups or optionally as the group $CH_2$—O—CO— and thus, together with the carbon atoms of the ring containing them, denoting a five-membered lactone.

A detergent or cleaning agent is understood according to the invention to include all agents which are suitable for washing or cleaning textiles and/or solid surfaces in particular. Ingredients suitable for this purpose are explained in detail below.

Proteases are understood according to the invention to include all enzymes capable of hydrolyzing acid amide bonds of proteins. The proteases are also described in greater detail below.

The compound represented by the general structural formula is an aromatic compound having two benzene rings which are linked according to feature (a) by a keto group or an acid amide group. This is thus a benzophenone derivative or a benzoic acid anilide derivative.

This benzophenone derivative may according to features (b) and (c) have as radicals R1, R2, R3, R4 and R5 (in ring 1) and/or R6, R7, R8, R9 and R10 (in ring 2) hydrogen (H), a carboxyl group (COON), a methyl group ($CH_3$), an ethyl group ($C_2H_5$), a hydroxyl group (OH), a hydroxymethyl group ($CH_2OH$), an amino group ($NH_2$) and/or a halogen. The prerequisite is that there must be at least one carboxyl group (COOH) in each of the two rings.

The same thing is also true of such a benzoic acid anilide derivative. Rings 1 and 2 may be differentiated here whereby ring 1 is the ring which can be attributed to benzoic acid and/or its substitution product, and ring 2 is the one that can be attributed to the aniline and/or its substitution product. This benzoic acid anilide derivative may also have hydrogen (H), a carboxyl group (COOH), a methyl group ($CH_3$), an ethyl group ($C_2H_5$), a hydroxyl group (OH), a hydroxymethyl group ($CH_2OH$), an amino group ($NH_2$) and/or a halogen as R1, R2, R3, R4 and R5 (in ring 1) and/or R6, R7, R8, R9 and R10 (in ring 2). The prerequisite again is that there must be at least one carboxyl group (COOH) in each of the two rings.

According to feature (d), such a benzophenone or benzoic acid anilide derivative is also relevant for the invention if it has two of the radicals R1 to R10 as (A) and (B) in ortho position to one another as possible substituents in one of the two rings 1 or 2, (A) being an obligatory carboxyl group (COOH) or optionally another carboxyl group, as mentioned in (b) and/or (c), and (B) being a hydroxymethyl group; these are present as such groups or optionally as the group $CH_2$—O—CO and thus together with the carbon atoms of the ring containing them form a five-membered lactone.

It is also possible for two of the substituents (A) and (B) which are possible according to (b) and (c) to be a carboxyl group (COOH) and/or a hydroxymethyl group, to be directly vicinal to one another in a ring, i.e., to be in ortho position to one another and to be present concurrently in the form of the hydroxyl group and the carboxymethyl group. In this case, it may happen that these two groups together form a lactone and bind in lactone form to the protease to be inhibited. It is also possible that the bonding occurs without prior development of the lactone form. For implementation of the present invention, it is also possible to specify the lactone form already in the synthesis and to add the lactone that has already been formed as a stabilizer to the respective agent. The most suitable form is to be determined experimentally on the basis of the protease to be inhibited and the intended stabilizer, which should not pose any fundamental difficulties for those skilled in the art.

In counting the carboxyl groups according to features (b) and (c) and the preferred embodiments which are based on the number of carboxyl groups present per molecule, this lactone carboxyl group is also counted as a carboxyl group according to feature (b) and/or (c) but may also be present in addition to another carboxyl group.

In another embodiment of the present invention, instead of one of the two benzene rings, a thiophene ring may also be present. The assignment of the possible substituents 1', 2', 3' therein is possible by analogy with the statements made above regarding features (b), (c) and (d).

This embodiment makes possible a similar non-covalent interaction with the protease to be inhibited, or in individual cases even a better non-covalent interaction via the aromatic thiophene ring. Furthermore, the sulfur atom contained therein permits additional interactions, in particular by way of the free electron pairs, which may be advantageous in the individual case. The especially suitable compounds of these are to be investigated for their kinetic parameters on the basis of the specific protease to be inhibited and are to be optimized through a suitable selection and arrangement of substituents. It is possible to rely here on experience gained on the basis of compounds with benzene rings.

The present invention comprises the aforementioned compounds in all protonated and/or deprotonated forms. In particular the carboxyl group(s) (COOH) and optionally the amino group(s) ($NH_2$) are present as carboxylate groups ($COO^-$) and/or as ammonium groups ($NH_3^+$), depending on the pH of the ambient medium. If necessary, oppositely charged cations ($H^+$, $Na^+$, $K^+$ or the like) and/or anions ($Cl^-$, $Br^-$, formate, acetate, etc.) may also be present. The present invention may be embodied in all these forms. The decisive factor is the interaction between the compound relevant to the invention and the protease to be inhibited/stabilized, respectively, according to the invention.

Without being limited to this theory, it is assumed according to the present invention that the compounds relevant to the invention form a complex with the protease to be inhibited/stabilized according to the invention. This complex is apparently such that the compound relevant to the invention is incorporated into the substrate binding pocket of the protease where it is bound in a non-covalent form. In this manner, the active center of the protease is blocked by a compound that cannot be hydrolyzed by this enzyme and is not available for hydrolysis of other proteins that are present. This involves reversible bonding, i.e., an equilibrium between association and dissociation. The equilibrium coefficient of this reaction is designated at the inhibition constant or $K_i$.

The first advantage of the compounds relevant to the invention in comparison with the prior art, in addition to their lower volume demand in comparison with the polyols, consists of the fact that they have favorable inhibition constants with respect to the proteases that can be used in washing and cleaning agents. This is true of serine proteases, for example, but also of metalloproteases. The inhibitors thus bind reversibly, i.e., they do not enter into transient interactions with the enzyme that are too fixed nor those that are too loose. During storage, most of the protease relevant to the invention is thus present in the form of a protease-inhibitor complex. The protease and optionally other proteins contained therein, in particular other enzymes, are protected from proteolysis by this enzyme in this way (stabilized against proteolysis). On the other hand, at the moment of dilution of the inventive agent with water to prepare an aqueous wash bath or cleaning bath during the cleaning process, the bond equilibrium is shifted in the direction of dissociation, so the complex dissolves and most of the protease relevant to the invention becomes proteolytically active. The compounds relevant to the invention are thus functioning protease inhibitors according to the object as formulated and are thus enzyme stabilizers for washing and cleaning agents.

The second advantage of the compounds relevant to the invention in comparison with the prior art consists of the fact that as elements they have only C, H, N and O and optionally halides and/or sulfur and in particular are free of boron. Thus they do not form the unwanted byproducts with other washing or cleaning agent ingredients that could be attributed to boron.

Furthermore, due to the carboxyl groups present in each aromatic ring in particular, they are readily soluble in water so that they can easily be incorporated into corresponding agents and precipitation during storage is prevented.

Essentially said compounds presumably act as reversible inhibitors because they are structurally identical to the substrate of the proteases in particular with regard to the acid amide bond to be hydrolyzed. Conversely, essentially all proteases can be fundamentally inhibited by the compounds relevant to the invention so that these are suitable as protease inhibitors according to the invention. This is true in particular of serine proteases, as demonstrated on the basis of the examples for the present patent application with the positive effect of the experimental compounds described there on the basis of serine proteases, specifically subtilases, even more specifically subtilisins, mainly on the basis of a variant of the subtilisin from *Bacillus lentus* DSM 5483.

Additional subjects of the present invention pertain to

- the use of a compound described above as a reversible inhibitor and/or stabilizer of a protease within the scope of a detergent or cleaning agent formulation;
- washing or cleaning methods in which a protease inhibited and/or stabilized with a compound described above is active;
- use of an inventive detergent or cleaning agent for washing and/or cleaning textiles and/or hard surfaces; as well as
- the use of a protease and a compound described above for preparation of a detergent of cleaning agent.

In all the inventive aspects, the stabilizing compound selected from one of the following stabilizers is especially preferred:

| Structural formula | Name |
|---|---|
| a) 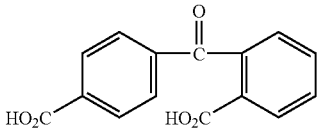 | 2-(4-Carboxybenzoyl)benzoic acid |
| b) 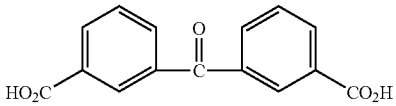 | 3,3'-Carbonylbisbenzoic acid |
| c) 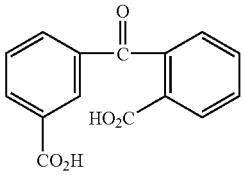 | 2-(3-Carboxybenzoyl)benzoic acid |
| d) 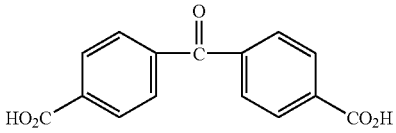 | 4,4'-Carbonylbisbenzoic acid |

-continued

| Structural formula | Name |
|---|---|
| e) 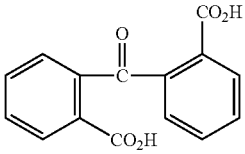 | 2,2'-Carbonylbisbenzoic acid |
| f) 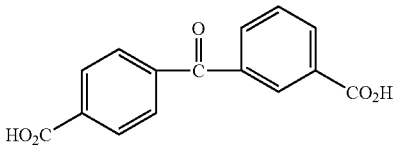 | 3-(4-Carboxybenzoyl)benzoic acid |
| g) 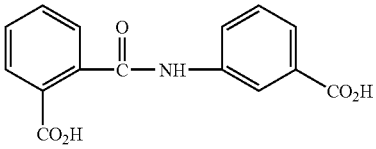 | 2-[[(3-Carboxyphenyl)amino]carbonyl]-benzoic acid |
| h) 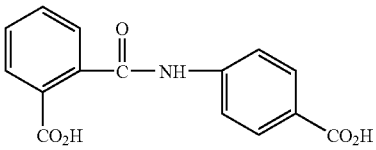 | 2-[[(4-Carboxyphenyl)amino]carbonyl]-benzoic acid |
| i) 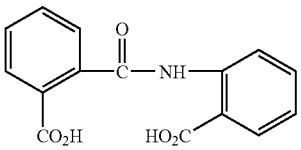 | 2-[(2-Carboxybenzoyl)amino]benzoic acid |
| j) 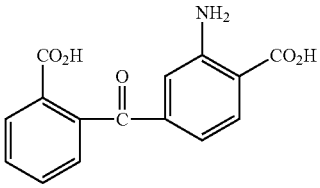 | 2-Amino-2',4-carbonylbisbenzoic acid |
| k) 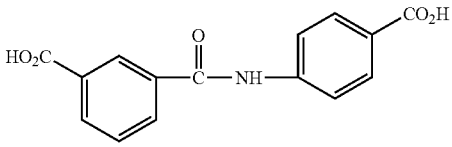 | 3-[[(4-Carboxyphenyl)amino]carbonyl]-benzoic acid |
| l) 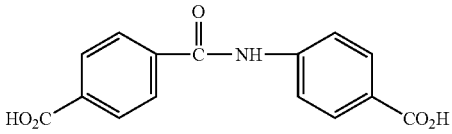 | 4-[(4-Carboxybenzoyl)amino]benzoic acid |
| m) 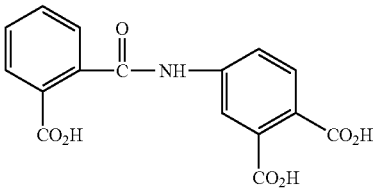 | 4-(2-Carboxylbenzyl)-1,2-benzene-dicarboxylic acid |

-continued

| Structural formula | Name |
|---|---|
| n) 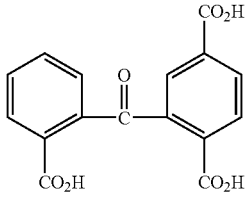 | 2-(2-Carboxybenzoyl)-1,4-benzene-dicarboxylic acid |
| o) 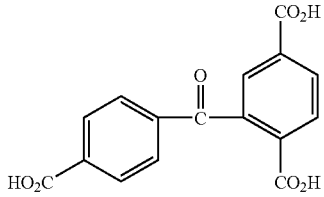 | 2-(4-Carboxybenzoyl)-1,4-benzene-dicarboxylic acid |
| p) 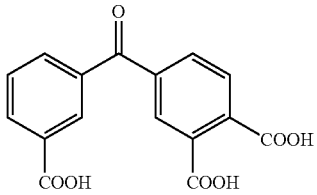 | 4-(3-carboxybenzoyl)-1,2-benzene-dicarboxylic acid |
| r) 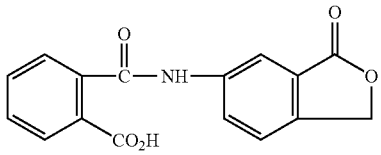 | 2-[[(1,3-Dihydro-3-oxo-5-isobenzo-furanyl)amino]carbonyl]benzoic acid |
| s) 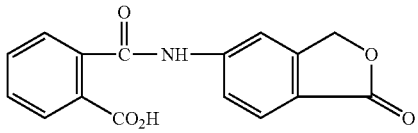 | 2-[[(1,3-Dihydro-1-oxo-5-isobenzo-furanyl)amino]carbonyl]benzoic acid |

According to the invention, washing or cleaning agents in which the stabilizing compound has an inhibition constant ($K_i$) of 0.01 to 10 mM, preferably 0.1 to 5, especially preferably 0.5 to 2 are preferred according to the invention.

The inhibition constant $K_i$ may be determined by the following method

For the characterization of a reversible inhibitor of enzyme activity, the inhibition constant $K_i$ is a characteristic and decisive quantity. $K_i$ describes the equilibrium between enzyme, inhibitor and enzyme-inhibitor complex for reversible bonding. The enzyme-inhibitor complex is not catalytically active and inhibits the reaction by reducing the concentration of free enzyme, which is still available for bonding of substrate. $K_i$ is defined accordingly as $$K_i=[I]\times[E]/[EI]$$

wherein [E], [I] and [EI] are the respective molar equilibrium concentrations of the enzyme (E), inhibitor (I) and enzyme-inhibitor complex (EI). According to this definition, a substance with a low $K_i$ under the respective test conditions is a good inhibitor.

$K_i$ is determined on the basis of the activity test of protease in the presence of the corresponding inhibitor. The enzymatic parameters $K_m$ and $k_{cat}$ are determined in the presence of various concentrations of the inhibitor based on the Michaelis-Menten kinetics which are familiar to those skilled in the art and are established in the prior art (Leonor Michaelis, Maud Menten (1913): The Kinetics of the Invertine Effect, *Biochem. Z.* 49:333-369). In simplified terms, the following equation holds for Michaelis-Menten kinetics:

$$E+S \underset{k_1}{\overset{k_1}{\rightleftharpoons}} ES \overset{k_2}{\rightarrow} E+P$$

wherein: E: enzyme

S: substrate

ES: enzyme-substrate complex

P: product $k_1$, $k_{-1}$, $k_2$: rate constants

In this equation, $k_2$ is a measure of the maximum reaction rate at substrate saturation ($V_{max}$), also known as the turnover number or molecular activity or $k_{cat}$ ($k_{cat}=V_{max}/[E_0]$, where $[E_0]$ is the starting concentration of enzyme). The Michaelis constant (i.e., the substrate concentration prevailing at half-saturation, at which the conversion rate, i.e., $v=V_{max}/2$) is thus obtained as follows:

$K_m = k_{-1}/k_1$ (Michaelis-Menten case, given when $k_2 << k_1$) or more generally $K_m = (k_{-1}+k_2)/k_1$ (Briggs-Haldane situation, given for the case when $k_2$ is not negligible with respect to $k_1$).

The saturation function of a "Michaelis-Menten enzyme" is obtained by using the parameters $K_m$ and $V_{max}$ as follows:

$$v = \frac{V_{max} \cdot [S]}{K_m + [S]}$$

wherein v: the rate of formation of P (v="velocity") ($mol \cdot L^{-1} \cdot s^{-1}$)

$V_{max}$: maximum rate ($mol \cdot L^{-1} \cdot s^{-1}$)

$K_m$: Michaelis-Menten constant ($mol \cdot L^{-1}$)

[S]: substrate concentration ($mol \cdot L^{-1}$)

The inhibition constant $K_i$ is obtained by determination of the initial catalysis rate ($v_{anf}$)—the initial hydrolysis rate for proteases—at various substrate concentrations [S] by fitting the experimental data into the following equation 1:

$$v_{anf} = k_{cat} \times [S] \times E_0 / (K_m \times (1 + [I]/K_i) + S) \quad \text{Equation 1}$$

where [I] again stands for the inhibitor concentration.

Alternatively, $K_i$ may be determined by using the Cheng-Prusoff equation (equation 2, Y. Cheng, W. H. Prusoff (1973), Biochem. Pharmacol. 22, 3099-3108) based on the $IC_{50}$ value. The $IC_{50}$ value is determined by determining the catalytic activity on a substrate in the presence of various concentrations of the inhibitor and adjusting the experimental data to a sigmoidal dose-effect equation with a variable slope (pseudo-Hill slopes). This is the inhibitor concentration required to achieve 50% inhibition.

$K_i$ is thus obtained from the following equation 2:

$$K_i = IC_{50} / (1 + [S]/K_d) \quad \text{Equation 2}$$

in which [S] denotes the substrate concentration in the test and $K_d$ denotes the dissociation constant for the substrate which can be equated with $K_m$ for the substrate as being identical at the $IC_{50}$ concentration of the inhibitor.

The $K_i$ values determined in this way characterize the compound with respect to the enzyme used. In Example 1, the residual activity of a protease, namely the *Bacillus lentus* alkaline protease F49 (according to WO 95/23221 A1) is determined in the presence of an inhibitor. Since this is a typical subtilisin protease, the values obtained with this enzyme are also typical of other serine proteases, in particular other subtilisin proteases. In case of doubt, the exact value for a protease of interest must be determined on the basis of the respective specific protease.

In the inventive washing or cleaning agents, which are present in predominantly solid form in a preferred embodiment and are present predominantly in liquid, paste or gel form in a second embodiment, the protease is contained in particular in an amount of 2 μg to 20 mg per g of the agent, preferably 5 μg to 17.5 mg per g of the agent, especially preferably from 20 μg to 15 mg per g of the agent, most especially preferably from 50 μg to 10 μg of the agent.

The stabilizer is especially present in the inventive agents in an amount of up to 50 mg per g of the agent, preferably up to 10 mg, especially preferably up to 7 mg, most especially preferably up to 5 mg per g of the agent. In addition, it is preferable for the stabilizer to be present in an amount of 0.01 to $100 \times K_i$ (based on the protease present), preferably 0.1 to $10 \times K_i$, especially preferably 1 to $5 \times K_i$.

The molar ratio of stabilizer to protease is preferably in the range of 1:1 to 1000:1 in particular 1:1 to 500:1 especially preferably from 1:1 to 100:1, most especially preferably from 1:1 to 20:1.

In addition to the stabilizer according to the general formula given above, an inventive agent may contain at least one additional stabilizer. In another embodiment of the invention, the detergent or cleaning agent is thus characterized in that it contains at least one additional stabilizer. Therefore, at least two compounds are present in such an agent, resulting in a stabilization of an enzyme contained therein, preferably a protease. These compounds preferably act synergistically, i.e., the stabilization effect achieved by the two compounds exceeds the sum of the two individual stabilization effects. In a preferred embodiment, the stabilizer(s) is/are one or more polyols, in particular glycerol or 1,2-ethylene glycol, an antioxidant, lactate or one or more lactate derivatives or combinations thereof. It is also preferably one or more of such enzyme stabilizing and/or inhibiting compounds disclosed in the International Patent Applications WO 07/113,241 A1 or WO 02/008398.

The protease which has been stabilized according to the invention and/or reversibly inhibited is preferably a serine protease, in particular a subtilase, especially preferably a subtilisin.

Examples of such proteases include the subtilisins BPN' and Carlsberg, the protease PB92, the subtilisins 147 and 309, the alkaline protease from *Bacillus lentus*, subtilisin DY and the subtilases, but not the enzymes thermitase, proteinase K or the proteases TW3 and TW7, which are no longer to be classified as subtilisins in the narrower sense. Subtilisin Carlsberg is obtainable in a further developed form under the brand name Alcalase® from the company Novozymes A/S, Bagsvaerd, Denmark. Subtilisins 147 and 309 are distributed under the brand name Esperase® and/or Savinase® by the company Novozymes. The protease variants carried under the designation BLAP® are derived from the protease obtained from *Bacillus lentus* DSM 5483.

Additional proteases include, for example, the enzymes available from the company Novozymes under the brand names Durazym®, Relase®, Everlase®, Nafizym, Natalase®, Kannase® and Ovozymes®, the enzymes available from the company Genencor under the brand names Purafect®, Purafect®OxP and Properase®, the enzyme available from the company Advanced Biochemicals Ltd. of Thane, India under the brand name Protosol®, the enzyme available from the company Wuxi Snyder Bioproducts Ltd. China under the brand name Wuxi®, the enzymes available from the company Amano Pharmaceuticals Ltd., Nagoya, Japan under the brand names Proleather® and Protease P® and the enzyme available from the company Kao Corp., Tokyo, Japan, under the brand name Proteinase K-16.

It has surprisingly been found that such proteases are stabilized and/or reversibly inhibited especially well by the compounds explained here. Furthermore, even certain variants of proteases, i.e., including variants of said proteases, are stabilized in an especially advantageous manner by these compounds. Such protease variants are part of the subjects of the invention described below.

A stabilized and/or reversibly inhibited protease according to the invention may be a wild-type enzyme or a protease variant. The term "wild-type enzyme" is to be understood as meaning that the enzyme is present in a naturally occurring organism and/or in a natural habitat, from which it can be isolated. However, enzymes are variable and are altered in a targeted manner to some extent, in particular to adapt their properties to the intended application provided or to influence their catalytic activity. These changes often take place due to a change in the amino acid sequence of the enzyme. Such changes may occur in a targeted manner and thus in a directional or random manner, e.g., due to random mutagenesis processes. An enzyme variant is understood to refer to enzymes created from a starting system, e.g., a wild-type enzyme, by a change in the amino acid sequence. The change in the amino acid sequence preferably takes place through mutations, whereby amino acid substitutions, deletions, insertions or combinations thereof may be performed. Introduction of such mutations into proteins is state of the art and is sufficiently well known to those skilled in the art in the field of enzyme technology. Essentially all enzymes may be altered in this way. Protease variants are preferred according to the invention. These have been created from a starting protease, e.g., a wild-type protease by changing the amino acid sequence, whereby preferably amino acid substitutions, deletions, insertions or combinations thereof have been performed. However, the starting protease need not necessarily be a naturally occurring wild-type protease. A protease known from the prior art in which changes have already been made may be developed further and therefore may serve again as a starting protease for creating additional protease variants.

Thus, for example, all the proteases described above may be used in the inventive agents with no change and may be stabilized by the compounds described here. However, they may also represent the starting enzyme for a variant which is then contained in an inventive agent and is stabilized by the compounds described here.

The wild-type enzyme and/or the starting enzyme of the following variants is additionally preferred of all the proteases and/or variants described here:

- the alkaline protease from *Bacillus amyloliquefaciens* (BPN'),
- the alkaline protease from *Bacillus licheniformis* (subtilisin Carlsberg),
- the alkaline protease PB92,
- subtilisin 147 and/or subtilisin 309 (savinase),
- the alkaline protease from *Bacillus lentus* preferably from *Bacillus lentus* DSM 5483,
- the alkaline protease from *Bacillus alcalophilus* (DSM 11233),
- the alkaline protease from *Bacillus gibsonii* (DSM 14391) or an alkaline protease at least 70% identical to the former,
- the alkaline protease from *Bacillus* sp. (DSM 14390) or an alkaline protease at least 98.5% identical to the former,
- the alkaline protease from *Bacillus* sp. (DSM 14392) or an alkaline protease at least 98.1% identical to the former,
- the alkaline protease from *Bacillus gibsonii* (DSM 14393) or an alkaline protease at least 70% identical to the former.

In another embodiment of the invention, the detergent or cleaning agent is therefore characterized in that the protease is obtained from a starting protease by at least one change in an amino acid, such that the change is a substitution, insertion or deletion of an amino acid and is at least 90% identical to the starting protease on an amino acid level, preferably at least 92.5% identical, especially preferably at least 95% identical, and most especially preferably at least 97.5% identical.

Those skilled in the art are familiar with methods of performing and creating sequence comparisons, so-called alignments, from the field of enzyme technology. The identity values or homology values for comparative sequences, for example, are determined by means of such sequence comparisons. Such a comparison is performed by assigning similar sequences in the nucleotide or amino acid sequences of the proteins in question to one another. This is known as homologization. A tabulated assignment of the respective positions is known as alignment. In the analysis of nucleotide sequences, both complementary strands and all three possible reading frames must again be taken into account. Likewise, the degenerate nature of the genetic code and the organism-specific use of the codons (codon usage) are to be taken into account. In the meantime, alignments are generated by computer programs, e.g., using the FASTA or BLAST algorithms. This procedure is described by D. J. Lipman and W. R. Pearson (1985) in Science, vol. 227, pp. 1435-1441, for example.

A compilation of all positions that correspond in the sequences thus compared is known as a consensus sequence.

Such a comparison also allows a statement about the similarity or homology of the sequences compared to one another. This is given in percentage identity, i.e., the percentage of the identical nucleotides or amino acid radicals in the same positions and/or in alignment of corresponding positions. A more broadly interpreted homology term includes the preserved amino acid exchanges in this value. We then speak of percentage similarity. Such statements may be made about whole proteins or genes or just individual regions.

Homologous regions of different proteins are defined by correspondences in the amino acid sequence. These may also be characterized by identical functions. This goes as far as complete identities in extremely small regions, so-called boxes, comprising only a few amino acids, usually exerting essential functions for the overall activity. The functions of the homologous regions are understood to be extremely small subfunctions of the function performed by the protein as a whole, such as the development of individual hydrogen bridge bonds for complexing a substrate or a transition complex.

Such sequence comparisons and/or alignments also serve to in particular determine corresponding positions in different molecules. For example, in an alignment of different enzymes, it is possible to ascertain which positions in the respective amino acid sequence or nucleic acid sequence correspond to one another even if the respective sequences have different total lengths or different domains and/or subsequences, for example, or if additional amino acids and/or nucleotides are present within a sequence. Therefore, a corresponding position in a second sequence may be assigned specifically to a certain position in a first sequence, and it is quite possible for the corresponding positions to be located at different places in the molecule. Furthermore, different amino acid radicals may be present at the corresponding positions. Therefore, for such sequence comparisons and/or for determination of a position, it is stated in concrete terms which position is involved and which enzyme is used as the starting material, i.e., which method of counting is to be used as the basis for the determination of position.

For the following inventive subjects, the amino acid sequence of the mature protein of the alkaline protease from *Bacillus lentus* DSM 5483 is used for the position determination, as disclosed in the Unexamined International Patent WO 91/02792 A1, and which has a length of 269 amino acid radicals (referred to as the alkaline protease from *Bacillus lentus* in the present patent application).

In another embodiment of the invention, the detergent or cleaning agent is characterized in that the protease is obtained from a starting protease by at least one change in an amino acid, where the change is a substitution or insertion of an amino acid in the area of the amino acid sequence assigned to the positions 95 to 103 of the alkaline protease from *Bacillus lentus* in an alignment.

Such a protease variant is especially preferably a variant with an insertion of a single amino acid according to one or more of positions 95, 96, 97, 98, 99, 100, 101, 102 and/or 103 and most especially preferably between positions 97 and 98 and/or positions 99 and 100.

In another embodiment of the invention, the detergent or cleaning agent is characterized in that the protease is obtained from a starting protease by at least one alteration of an amino acid assigned to positions 3, 4, 36, 42, 43, 47, 56, 61, 69, 87, 96, 99, 101, 102, 104, 114, 118, 120, 130, 139, 141, 142, 154, 157, 188, 193, 199, 205, 211, 224, 229, 236, 237, 242, 243, 250, 253, 255 and 268 of the alkaline protease from *Bacillus lentus* in an alignment, whereby the change is a substitution, insertion or deletion of an amino acid.

There is especially preferably an amino acid change in comparison with the starting molecule in one or more of the following positions: 3, 4, 43, 61, 188, 193, 199, 211, 224, 250 and 253 (counting according to the alkaline protease from *Bacillus lentus*), especially preferably with one or more amino acid exchanges X3T, X41, X43V, X61A, X188P, X193M, X1991, X211L, X211D, X211E, X211G, X211N or X211Q, X224V, X250G and/or X253N. This protease is in particular a variant with a point mutation in position 211, preferably with a substitution of a single amino acid in this position, especially preferably with the amino acid substitution X211L. The position information above again refers to the amino acid radicals which are assigned to said positions of the alkaline protease from *Bacillus lentus* in an alignment.

In addition to the protease, inventive agents may contain one or more other enzymes, in particular from the following group: one or more additional proteases, amylases, hemicellulases, cellulases, lipases and oxidoreductases. The amylase is preferably an α-amylase. The hemicellulase is preferably a β-glucanase, a pectinase, a pullulanase and/or a mannanase. The cellulase is preferably a cellulase mixture of a single-component cellulase, preferably and/or predominantly an endoglucanase and/or a cellobiohydrolase. The oxidoreductase is preferably an oxidase, in particular a choline oxidase or a perhydrolase.

Inventive agents preferably contain at least one complexing agent and/or builder substances, where the builder is in particular a zeolite builder and/or a nonionic surfactant, where the nonionic surfactant is preferably a hydroxy mixed ether and/or an optical brightener, where the optical brightener comprises diphenyl compounds, in particular distyrylbiphenyl derivatives and/or stilbene-triazine derivatives.

While particular embodiments of the present invention have been illustrated and described, it would be obvious to those skilled in the art that various other changes and modifications can be made without departing from the spirit and scope of the invention.

Other than where otherwise indicated, or where required to distinguish over the prior art, all numbers expressing quantities of ingredients herein are to be understood as modified in all instances by the term "about". As used herein, the words "may" and "may be" are to be interpreted in an open-ended, non-restrictive manner. At minimum, "may" and "may be" are to be interpreted as definitively including, but not limited to, the composition, structure, or act recited.

As used herein, and in particular as used herein to define the elements of the claims that follow, the articles "a" and "an" are synonymous and used interchangeably with "at least one" or "one or more," disclosing or encompassing both the singular and the plural, unless specifically defined herein otherwise. The conjunction "or" is used herein in both in the conjunctive and disjunctive sense, such that phrases or terms conjoined by "or" disclose or encompass each phrase or term alone as well as any combination so conjoined, unless specifically defined herein otherwise.

The description of a group or class of materials as suitable or preferred for a given purpose in connection with the invention implies that mixtures of any two or more of the members of the group or class are equally suitable or preferred. Description of constituents in chemical terms refers unless otherwise indicated, to the constituents at the time of addition to any combination specified in the description, and does not necessarily preclude chemical interactions among the constituents of a mixture once mixed. Steps in any method disclosed or claimed need not be performed in the order recited, except as otherwise specifically disclosed or claimed.

Changes in form and substitution of equivalents are contemplated as circumstances may suggest or render expedient. Although specific terms have been employed herein, such terms are intended in a descriptive sense and not for purposes of limitation.

The following Examples further illustrate the preferred embodiments within the scope of the present invention, but are not intended to be limiting thereof. It is understood that the examples and embodiments described herein are for illustrative purposes only and that various modifications or changes in light thereof will be suggested to one skilled in the art without departing from the scope of the present invention. The appended claims therefore are intended to cover all such changes and modifications that are within the scope of this invention.

EXAMPLES

Example 1

Testing Residual Protease Activity in the Presence of an Inhibitor

To verify that the compounds listed below have a protease activity-inhibiting effect, the residual proteolytic activity of the *Bacillus lentus* alkaline protease F49 (according to WO 95/23221 A1) was determined in the presence of these compounds.

The substrate succinyl-alanine-alanine-proline-phenylalanine-para-nitroanilide (AAPFpNA; Bachem L-1400) and $5\times10^{-9}$ and/or $1\times10^{-8}$ M of the protease were placed in 100 mM Tris buffer. The compounds to be tested as listed in Table 1 were then added in a final concentration of 10 mM. Each was dissolved in anhydrous DMSO, correcting for the effect of DMSO on the enzymatic activity by means of a corresponding reference with the same amount of DMSO but without the respective compound. The batches were incubated for 5 minutes at pH 8.6 and 25° C., where 1 U corresponds to 1 μmol substrate cleaved per minute.

The following compounds were tested in this way:

V1: 2-[[(3-carboxyphenyl)amino]carbonyl]benzoic acid
V2: 2-[(2-carboxybenzoyl)amino]benzoic acid
V3: 2-[[(4-carboxyphenyl)amino]carbonyl]benzoic acid
V4: 2-(4-carboxybenzoyl)benzoic acid
V5: 4-(2-carboxybenzoyl)-1,2-benzenedicarboxylic acid All of these led to a residual protease activity of 50% or less. V1 is the strongest of these and therefore is the most suitable protease inhibitor and/or stabilizer, followed by V2, V3, V4 (practically just as good as V3) and V5.

On the basis of these findings, these compounds are also suitable for stabilizing the enzymatic activities in washing and cleaning agents that contain protease.

Example 2

Investigating the Stability of Washing and Cleaning Agents Containing Protease in Storage in the Presence of Protease Inhibitors A liquid detergent with the following composition was prepared as the basic recipe (all amounts given in percent by weight): 0.3-0.5% xanthan gum, 0.2-0.4% antifoam agent, 6-7% glycerol, 0.3-0.5% ethanol, 4-7% FAEOS, 24-28% nonionic surfactants, 1% boric acid, 1-2% sodium citrate (dihydrate), 2-4% soda, 14-16% coconut fatty acids, 0.5% HEDP, 0-0.4% PVP, 0-0.05% optical brightener, 0-0.001% coloring agent, remainder demineralized water.

This recipe was mixed with the inhibiting compounds to be tested and 1,275,000 HPU/L *B. lentus* alkaline protease F49. The protease activity given in HPU (Henkel protease units) was determined according to van Raay, Saran and Verbeek, as described in the article: "For determination of the proteolytic activity in enzyme concentrates and enzyme-containing washing, cleaning agents and dishwashing agents" in Tenside [Surfactants] (1970), vol. 7, pp. 125-132.

Storage was for various periods of time in airtight sealed containers at 30° C.

For analysis, the initial values for the proteolytic activity of the respective agent were compared with the values determined after storage. The higher the activity remaining after storage, the better the inactivation of the protease contained therein during storage and the more suitable the respective compound as the inventive stabilizer.

All the compounds tested had a clearly stabilizing effect.

What is claimed:

1. A washing or cleaning agent, comprising a protease and a stabilizing compound of the structural formula

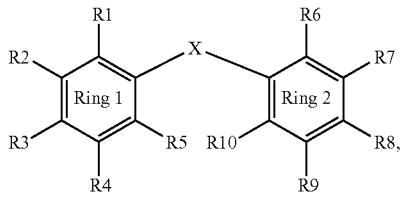

in which (a) X stands for a carbonyl group (C═O) or an acid amide group (NHCO), (b) R1, R2, R3, R4 and R5 (in ring 1) stand for hydrogen (H), a carboxyl group (COOH), a methyl group ($CH_3$), an ethyl group ($C_2H_5$), a hydroxyl group (OH), a hydroxymethyl group ($CH_2OH$), an amino group ($NH_2$) and/or a halogen, such that at least one carboxyl group (COOH) is present in ring 1;

(c) R6, R7, R8, R9 and R10 (in ring 2) stand for hydrogen (H), a carboxyl group (COOH), a methyl group ($CH_3$), an ethyl group ($C_2H_5$), a hydroxyl group (OH), a hydroxymethyl group ($CH_2OH$), an amino group ($NH_2$) and/or a halogen, such that at least one carboxyl group (COOH) is present in ring 2; and (d) optionally two of the radicals R1 to R10 (A) and (B) are in ortho position to one another, (A) being an obligatory carboxyl group (COOH) mentioned in (b) and/or (c) or optionally an additional carboxyl group, and (B) being a hydroxymethyl group, which are present as such groups or optionally as the group $CH_2$—O—CO— and thus together with the carbon atoms of the ring having them denote a five-membered lactone.

2. A method of reversibly inhibiting a protease in a washing or cleaning agent, comprising the steps of forming a washing or cleaning agent comprising a protease and an amount of a stabilizing compound of the structural formula

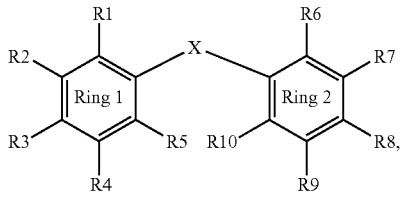

in which (a) X stands for a carbonyl group (C═O ) or an acid amide group (NHCO), (b) R1, R2, R3, R4 and R5 (in ring 1) stand for hydrogen (H), a carboxyl group (COOH), a methyl group ($CH_3$), an ethyl group ($C_2H_5$), a hydroxyl group (OH), a hydroxymethyl group ($CH_2OH$), an amino group ($NH_2$) and/or a halogen, such that at least one carboxyl group (COOH) is present in this ring, (c) R6, R7, R8, R9 and R10 (in ring 2) stand for hydrogen (H), a carboxyl group (COOH), a methyl group ($CH_3$), an ethyl group ($C_2H_5$), a hydroxyl group (OH), a hydroxymethyl group ($CH_2OH$), an amino group ($NH_2$) and/or a halogen, such that at least one carboxyl group (COOH) is present in this ring, and (d) optionally two of the radicals R1 to R10 are (A) and (B), which are in ortho position to one another, (A) being an obligatory carboxyl group (COOH) mentioned in (b) and/or (c) or optionally an additional carboxyl group, and (B) being a hydroxymethyl group, which are present as such groups or optionally as the group $CH_2$—O—CO— and thus together with the carbon atoms of the ring having them denote a five-membered lactone, effective to inhibit the activity of the protease during storing conditions.

3. A method of washing and/or cleaning textiles and/or hard surfaces comprising contacting a textile or hard surface with a washing-or cleaning-effective amount of the agent of claim 1.

4. A method of making a washing or cleaning agent, comprising the steps of combining a protease and a compound of the structural formula

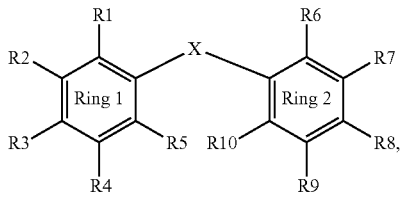

in which (a) X stands for a carbonyl group (C═O ) or an acid amide group (NHCO), (b) R1, R2, R3, R4 and R5 (in ring 1) stand for hydrogen (H), a carboxyl group (COOH), a methyl group ($CH_3$), an ethyl group ($C_2H_5$), a hydroxyl group (OH), a hydroxymethyl group ($CH_2OH$), an amino group ($NH_2$) and/or a halogen, such that at least one carboxyl group (COOH) is present in this ring, (c) R6, R7, R8, R9 and R10 (in ring 2) stand for hydrogen (H), a carboxyl group (COOH), a methyl group ($CH_3$), an ethyl group ($C_2H_5$), a hydroxyl group (OH), a hydroxymethyl group ($CH_2OH$), an amino group ($NH_2$) and/or a halogen, such that at least one carboxyl group (COOH) is present in this ring, and (d) optionally two of the radicals R1 to R10 are (A) and (B), which are in ortho position to one another, (A) being an obligatory carboxyl group (COOH) mentioned in (b) and/or (c) or optionally an additional carboxyl group, and (B) being a hydroxymethyl group, which are present as such groups or optionally as the group $CH_2$—O—COand thus together with the carbon atoms of the ring having them denote a five-membered lactone.

5. The method of claim 2, wherein the stabilizing compound has, in each of the two aromatic rings, one to three carboxyl groups, such that a carboxyl group bound in a lactone according to (d) is also counted.

6. The method of claim 2, wherein the stabilizing compound has an inhibition constant ($K_i$) of 0.01 to 10 mM with respect to the protease.

7. The method of claim 2, wherein the washing or cleaning agent comprises one or more stabilizing compounds selected from the group consisting of 2-(4-Carboxybenzoyl)benzoic acid, 3,3'-Carbonylbisbenzoic acid, 2-(3-Carboxybenzoyl) benzoic acid, 4,4'-Carbonylbisbenzoic acid, 2,2'-Carbonylbisbenzoic acid, 3-(4-Carboxybenzoyl)benzoic acid, 2-[[(3-Carboxyphenyl)amino]carbonyl]benzoic acid, 2-[[(4-Carboxyphenyl)amino]carbonyl]benzoic acid, 2-[(2-Carboxybenzoyl)amino]benzoic acid, 2-Amino-2',4-carbonylbisbenzoic acid, 3-[[(4-Carboxyphenyl)amino] carbonyl]benzoic acid, 4-[(4-Carboxybenzoyl)amino] benzoic acid, 4-(2-Carboxylbenzoyl)-1,2-benzene-dicarboxylic acid, 2-(2-Carboxybenzoyl)-1,4-benzene-dicarboxylic acid, 2-(4-Carboxybenzoyl)-1,4-benzene-dicarboxylic acid, 4-(3-carboxybenzoyl)-1,2-benzene-dicarboxylic acid, 2-[[(1,3-Dihydro-3-oxo-5-isobenzo-furanyl)amino]carbonyl]benzoic acid, and 2-[[(1,3-Dihydro-1-oxo-5-isobenzo-furanyl)amino]carbonyl]benzoic acid.

8. The method of claim 2, wherein the washing or cleaning agent is in predominantly solid form.

9. The method of claim 2, wherein the washing or cleaning agent is in predominantly liquid, paste, or gel form.

10. The method of claim 2, wherein the protease is present in the washing or cleaning agent in an amount of 2 μg to 20 mg per g of the agent.

11. The method of claim 2, wherein the stabilizing compound is present in the washing or cleaning agent in an amount of up to 50 mg per g of the agent.

12. The method of claim 2, wherein the molar ratio of stabilizer to protease in the washing or cleaning agent is in the range of 1:1 to 1000:1.

13. The method of claim 2, wherein the stabilizing compound is present in the washing or cleaning agent in an amount of 0.01 to $100 \times K_I$ (based on the protease contained therein).

14. The method of claim 2, wherein the protease is a serine protease.

* * * * *